US006224475B1

(12) United States Patent
May et al.

(10) Patent No.: US 6,224,475 B1
(45) Date of Patent: May 1, 2001

(54) SHARPENER SHEATH

(75) Inventors: David May, Geneva; Diane Subsits, Chicago; Timothy Nowack, Chicago; Daiying Huang, Chicago, all of IL (US)

(73) Assignee: The Pampered Chef, Ltd., Addison, IL (US)

( * ) Notice: Subject to any disclaimer, the term of this patent is extended or adjusted under 35 U.S.C. 154(b) by 0 days.

(21) Appl. No.: 09/258,535

(22) Filed: Feb. 26, 1999

(51) Int. Cl.[7] ..... B24B 15/08

(52) U.S. Cl. ..... 451/555; 457/555; 457/556; 457/558; 30/298.4

(58) Field of Search ..... 457/555, 559; 76/82; 30/298.4

(56) References Cited

U.S. PATENT DOCUMENTS

| | | | | |
|---|---|---|---|---|
| D. 225,559 | | 12/1972 | Bayly . | |
| D. 279,951 | | 8/1985 | Winyard . | |
| D. 296,498 | | 7/1988 | Collins et al. . | |
| D. 303,731 | | 10/1989 | Blochlinger et al. . | |
| D. 330,491 | | 10/1992 | Worsfold et al. . | |
| D. 339,963 | | 10/1993 | Roberts et al. . | |
| 1,477,488 | | 12/1923 | Holland . | |
| 3,676,961 | * | 7/1972 | Jackson | 451/555 |
| 3,774,350 | | 11/1973 | Bayly . | |
| 3,861,246 | * | 1/1975 | Waller | 76/86 |
| 3,986,304 | | 10/1976 | Shie, III . | |
| 4,041,651 | | 8/1977 | Bayly . | |
| 4,062,111 | | 12/1977 | Clark . | |
| 4,091,691 | | 5/1978 | Bayly . | |
| 4,117,748 | | 10/1978 | Watts . | |
| 4,494,339 | | 1/1985 | Pittaway . | |
| 4,654,968 | * | 4/1987 | Gatley et al. | 30/138 |
| 4,669,337 | | 6/1987 | Petroff . | |
| 4,718,200 | * | 1/1988 | Miquelot | 451/555 |
| 4,794,738 | | 1/1989 | Brignoli . | |
| 4,805,350 | | 2/1989 | Farrer . | |
| 4,869,027 | | 9/1989 | McEvily . | |
| 4,974,322 | | 12/1990 | Butka . | |
| 5,009,040 | * | 4/1991 | Petroff | 451/555 |
| 5,101,704 | | 4/1992 | Jones et al. . | |
| 5,121,659 | | 6/1992 | Williams . | |
| 5,784,786 | * | 7/1998 | Williams | 30/138 |

OTHER PUBLICATIONS

The Pampered Chef; Spring/Summer 1998 catalog; p. 4, Self–Sharpening Knives (Mar. 1988).

* cited by examiner

*Primary Examiner*—David A. Scherbel
*Assistant Examiner*—G. Nguyen
(74) *Attorney, Agent, or Firm*—Olson & Hierl, Ltd.

(57) ABSTRACT

The present invention is a device for storing and selectively sharpening a knife. The present invention includes a scabbard with opposing first and second ends. An opening is defined in the first end and a passage defined in the scabbard for receiving a knife blade. The device further includes a sharpening device and an engagement device, where the engagement device is in operable communication with the scabbard for selectively moving the sharpening device relative to the scabbard.

20 Claims, 4 Drawing Sheets

SHARPENER SHEATH

TECHNICAL FIELD OF THE INVENTION

This invention relates to a sheath for storing a knife blade and particularly to a sheath for storing and selectively sharpening a knife blade.

BACKGROUND OF THE INVENTION

It is troublesome to constantly maintain ordinary household knifes in a sharpened condition due to the variations in actual use time of the knife. The user does not always remember to sharpen the knife blade until the knife is so dull that it will not cut efficiently. Often, it is not convenient to hone the knife blade before or after each use, so that over time, the knife blade becomes dull, rendering it difficult to use.

A number of prior art patents have recognized this deficiency with such ordinary knife blades and proposed sharpener sheaths that sharpen the knife blade upon every insertion or withdrawal from the sharpener sheath. Typical patents in this area include U.S. Pat. Nos. 3,774,350 and 4,041,651.

In such prior art sharpener sheaths, the sharpening action has been achieved on each insertion and/or withdrawal of the knife blade to or from the scabbard. The edge of the knife blade engages a fixed sharpening device carried on the scabbard, which is designed to sharpen the blade edge upon each insertion/withdrawal.

Although such sharpener sheaths are effective in sharpening the blade edge, one disadvantage is the sharp edge emerging from the scabbard during, and as part of, the sharpening action. Such an emerging sharp edge may present a risk both to the person withdrawing the knife blade and to objects, such as work surfaces, which are immediately adjacent the emerging blade edge, both of which can be cut by the freshly sharpened edge.

It has further been realized that sharpening the knife blade on every insertion/withdrawal has other disadvantages, the greatest of which is that sharpening may not be required with such frequency. In fact, such frequent sharpening may damage the knife blade, causing excessive wear. The sharpening action causes metal to be removed from the knife blade each time the knife is inserted/withdrawn from the scabbard. Most of the time, specifically after a single use, it is not necessary to sharpen the blade. Hence, these prior art devices can cause excessive wear of the blade.

Yet a further disadvantage of some of the prior art sharpener sheaths is that they fail to provide for safe storage of the knife blade in the sheath or the safe storage of the sheath as a whole. Some of the prior art sharpener sheaths provide a locking device to lock the knife blade in the sheath for storage. However, most of such sharpener sheaths referred to above fail to lock the sharpening device and the blade, so that the sheath, including the blade, may be safely stored.

SUMMARY OF THE INVENTION

The present invention relates to a new and useful sharpener sheath for a knife blade that provides for storing and selectively sharpening a knife blade. The present sharpener sheath provides for sharpening the blade of a knife upon insertion or withdrawal of the blade, as selected by the user. Alternatively, the present sheath provides for insertion and withdrawal of the blade without sharpening, as selected by the user. In addition, the present sharpener sheath provides locking devices for locking the blade in the sheath using friction and locking the sheath for safe storage.

The sharpener sheath includes a scabbard having opposing first and second ends, with an opening defined in the first end. A passage is defined in the scabbard in fluid communication with the opening, so that the blade may be placed into and withdrawn from the sheath. The sheath additionally includes a sharpening device and an engagement device in operable communication with the scabbard for selectively moving the sharpening device relative to the scabbard.

The present sharpener sheath additionally includes a locking device for frictionally locking the knife therein, so that the knife is prevented from being unintentionally or accidentally removed from the scabbard. It is further contemplated that the sharpener sheath include a trigger lock device for selectively locking the engagement device in an engaging position for continuous sharpening and storage in a drawer for example.

In one preferred embodiment, it is contemplated that the sharpener sheath include a sharpener portion, preferably including at least one sharpening edge, contained in the scabbard for selective sharpening engagement with an edge of the knife blade. Finally, a biasing device, preferably a spring member, is also contemplated for biasing the engagement device, preferably a trigger device, in a disengaging position.

Various other objects, aims, purposes, features, advantages, embodiments, variations and the like will be apparent to those skilled in the art from the teachings of the present specification taken with the associated drawings and the appended claims.

DESCRIPTION OF THE PREFERRED EMBODIMENT

While this invention is susceptible to embodiments in many different forms, this specification and the accompanying drawings disclose only preferred forms as examples of the invention. The invention is not intended to be limited to the embodiments described, however. The scope of the invention is identified in the appended claims.

Embodiments of the contemplated device illustrated in the FIGURES show details of mechanical elements well known in the art and that will be recognized by those skilled in the art as such. The detailed description is not necessary to the understanding of the invention. Accordingly, such elements are herein represented only to the degree necessary to aid an understanding of the features of the present invention.

Figure 1:
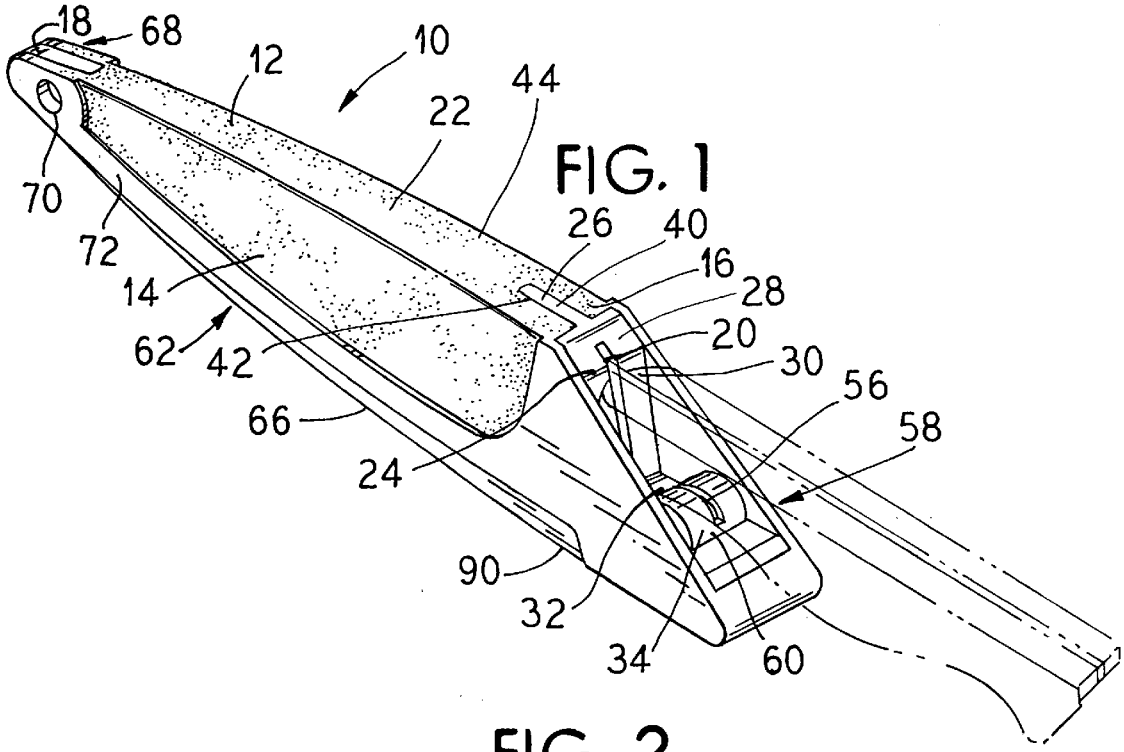
FIG. 1 is a perspective view of the sharpener sheath in accordance with the present invention, depicting the knife in phantom.

A sharpener sheath device is provided for storing and selectively sharpening a knife, generally designated as 10, suitable for use in accordance with the present invention. Turning to FIG. 1, sheath 10 is shown storing a knife blade (shown in phantom). Sheath 10 includes a scabbard 12 having an outer surface 14, with opposing first and second ends 16, 18. An opening 20 defined by outer surface 14 is defined in first end 16. In one preferred embodiment, scabbard 12, made of rigid plastic suitable for injection molding, has a curved triangle-like shape when viewed from the top and side (best seen in FIGS. 2, 3, 4 and 5). While rigid plastic and a triangle-like shape are described, other configurations and materials, including wood, stainless steel, aluminum, aluminum alloys, steel alloy, and PVC are contemplated.

While it is contemplated that scabbard 12 is formed as one piece, in the depicted embodiment scabbard 12 is comprised of a housing 22 and a cap 24 which is connected to housing 22. Cap 24 is shown having first flat section 26 (best seen in FIG. 7), angled section 28, second flat section 30, third flat section 32, curved section 34 and tab 36 (best seen in FIG. 5).

Cap 24 is inserted into the housing 22 so that first flat section 26 is in communication with an inner surface 38 (best seen in FIG. 7) preferably held in place by compression, but other means are contemplated including glue, bonding or the like. In the embodiment depicted in FIG. 1, first flat surface 26 includes an upstanding member 40 that engages a slot 42 formed in top surface 44. The engagement of upstanding member 40 and slot 42 not only assists in securing cap 24 in housing 22, but additionally acts as an alignment device during the assembly of the scabbard 12.

Figure 7:
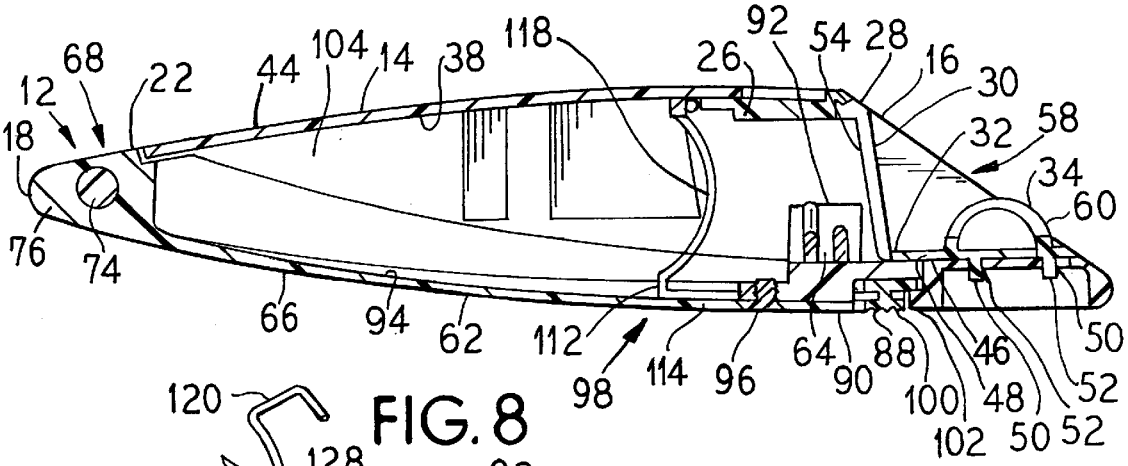
FIG. 7 is an left side elevational view (in relation to FIG. 1) partially in section taken substantially along line VII—VII of FIG. 4 with the trigger and trigger locking devices in an engaged position.

A careful review of FIGS. 1 and 7 further reveals that surface 46 of third flat section 32 engages a surface 48 of housing 22. In the preferred embodiment, third flat section 32 presses against surface 48 while first flat surface 26 cooperatively presses against inner surface 38. This cooperative interaction of third flat section 32 with surface 48 and first flat surface 26 with inner surface 38 secures the cap 22 in place at first end 16. Moreover, curved section 34 is depicted having at least two tabs 50 (best seen in FIG. 7) that engage corresponding slots 52, again securing cap 22 in place.

As discussed above, opening 20 is formed in first end 16. As depicted in FIG. 1, opening 20 is formed in cap 24 in fluid communication with a passage 54 defined in scabbard 12 (best seen in FIG. 7) for receiving the knife blade. Cap 22 further includes a slot 56 defined by curved section 34, where slot 56 assures proper alignment of the knife blade during insertion/withdrawal, specifically when a sharpening device is engaged.

Moreover, curved section 34, in conjunction with slot 56, and second and third flat sections 30, 32, act as a locking device 58 providing a friction fit with the handle, locking the knife blade in scabbard 12, whereby unintentional and accidental removal of the blade is prevented. A first, pointed end of the knife blade is lined up with slot 56 and the knife blade is inserted into the scabbard 12 via opening 20. During insertion, the foremost portion of the knife blade handle slidably engages a front engagement section 60 of curved section 34. As pressure is applied to the handle, the foremost portion of the handle slides over the front engagement section 60 and curved section 34 until it comes to rest between and frictionally engages second and third flat sections 30, 32.

The foremost portion of the handle is now located between the second flat section 30 and curved portion 34 so that the knife blade is effectively frictionally locked in the scabbard 12. The knife blade remains safely ensconced in the locking device 58, until upward and outward pressure is applied to the handle to overcome the friction fit and withdraw the knife blade from scabbard 12. Alternatively, other locking elements, including a locking chamber, a locking edge, latches, dogs and straps, among like devices, are contemplated for locking the knife blade in scabbard 12.

The sheath device 10 further includes an engagement device 62 in operable communication with the scabbard 12 for selectively moving a sharpening device 64 (not shown in FIG. 1) relative to the scabbard 12.

In one preferred embodiment, engagement device 62 is a trigger 66 formed of a rigid plastic, though other materials are contemplated as discussed above for scabbard 12. Trigger 66 is in operable communication with sharpening device 64, and with scabbard 12 at second end 18.

Trigger 66 is shown in operable communication with scabbard 22 via pivot device 68. Preferably, pivot device 68 is formed so that trigger 66 pivotably engages scabbard 12 at second end 18. Housing 22 defines at least one, but preferably two, apertures 70 formed in opposite side surfaces 72 of housing 22 and in co-axal alignment with each other. Trigger 66 includes two pegs 74 formed at distal end 76 that are aligned with, and pivotably engage, apertures 70 in a manner well known in the art, providing for pivotable movement of the trigger 66.

While apertures 70 and pegs 74 are preferred, other means are contemplated for providing pivotal movement of the trigger 66, including a pin or screw device inserted through trigger 66 and apertures 70.

Figure 2:
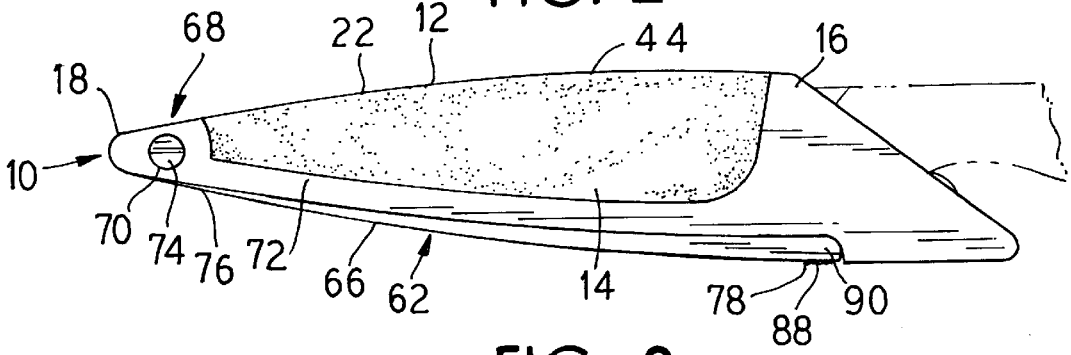
FIG. 2 is a left side elevational view (in relation to FIG. 1) of the sharpener sheath of FIG. 1 in accordance with the present invention, with the trigger shown in an engaged position and depicting the knife in phantom.

Turning now to FIG. 2, a left side (in relation to FIG. 1) of sheath 10 is depicted with trigger 66 in an engaged position, held in place by a trigger locking device 78 as discussed below. In this engaged position, as selected by the user, the knife blade is sharpened upon each insertion/withdrawal. Moreover, this engaged position is suitable for safely storing the sheath 10 (and the knife blade) in a drawer for example.

Figure 3:
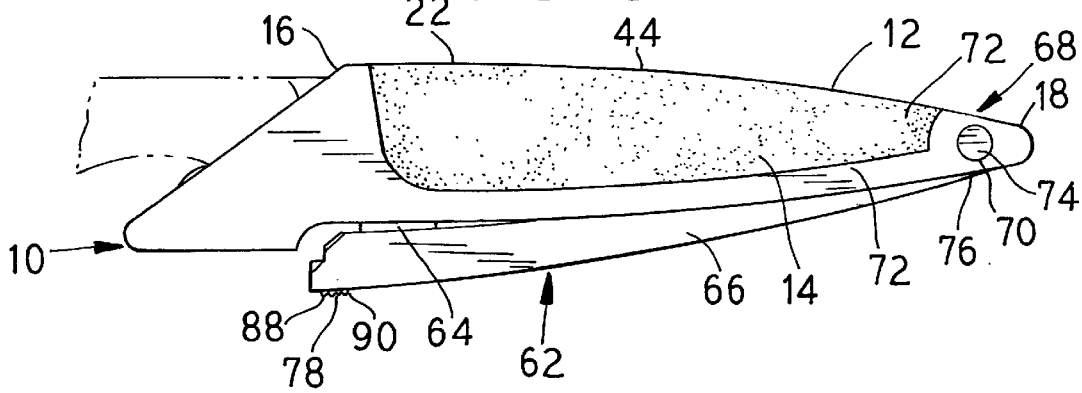
FIG. 3 is a right side elevational view (in relation to FIG. 1) of the sharpener sheath of FIG. 1 in accordance with the present invention, with the trigger member shown in a disengaged position and depicting the knife in phantom.

FIG. 3 depicts trigger 66 biased in an disengaged position, where trigger locking device 78 is positioned in a first, disengaged position. This allows the user to selectively sharpen the blade upon insertion/withdrawal, by moving trigger 66, and thus the sharpening device 64, into an engaged position, preferably by manually squeezing trigger 66 towards the housing 22.

Figure 4:
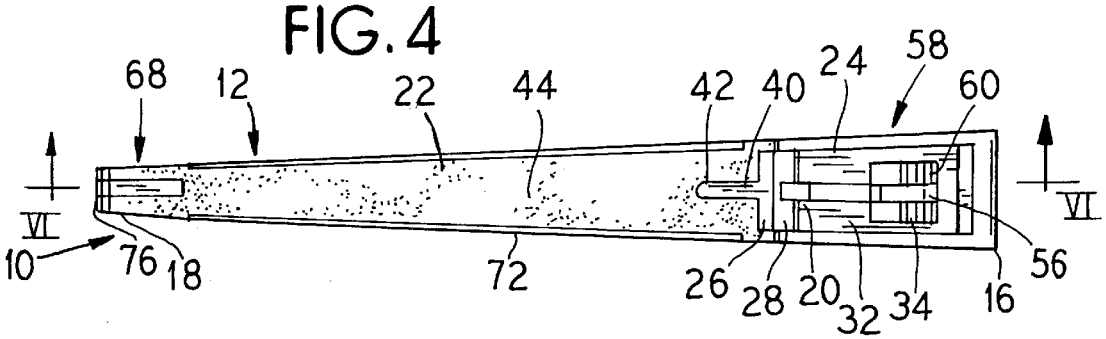
FIG. 4 is a top plan view of the sharpener sheath of FIG. 1 in accordance with the present invention.

FIG. 4 depicts a top plan view of the sheath device 10. From a review of FIG. 4, the relationship of the cap 24 with housing 22, including the relationship of upstanding member 40 and slot 42, as described above for FIG. 1 is better understood.

Figure 5:
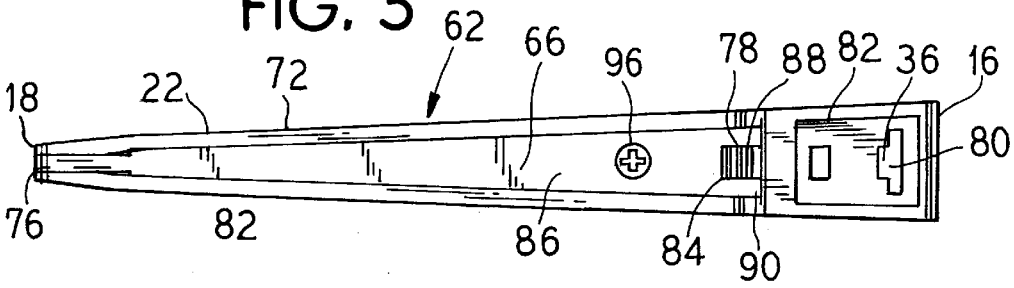
FIG. 5 is a bottom plan view of the sharpener sheath of FIG. 1 in accordance with the present invention, with the trigger locking device shown in an unengaged position.

A bottom plan view of the sharpener sheath device 10 is shown in FIG. 5. Tab 36 of the cap 24 is shown engaging a tab aperture 80 in bottom surface 82 of housing 22. Tab 36 and tab aperture 80 cooperatively interact, along with the interaction of third flat section 32, surface 48, first flat surface 26, and inner surface 38, to secure cap 24 to housing 22, as described above.

The operation of the trigger locking device 78 will also be better understood by reviewing FIG. 5. A trigger locking aperture 84 is formed in trigger 66, defined by a trigger bottom surface 86. Trigger locking device 78 is inserted into trigger locking aperture 84 with finger engagement portion 88 (best seen in FIG. 10) extending therefrom. In this manner, using finger engagement portion 88, the user can move trigger locking device 78 in trigger locking aperture 84 in a reciprocal manner.

In FIG. 5, trigger locking device 78 is depicted in a disengaged or unlocked position, where trigger locking device 78 is moved toward distal end 76. Trigger locking device 78 is moved away from proximal end 90 of trigger 66, so that trigger 66 is biased in an disengaged position (best seen in FIG. 3). This allows the user to selectively sharpen the blade upon insertion/withdrawal, by moving trigger 66, and thus the sharpening device 64, into an engaged position, preferably by manually squeezing trigger 66 towards the housing 22. As long as trigger 66 is not moved into the engaged position, the knife blade can be inserted/withdrawn without sharpening.

Figure 6:
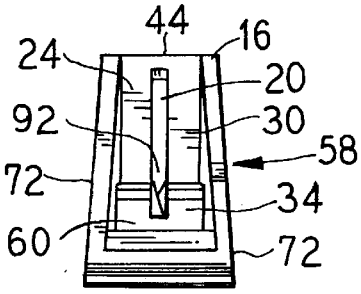
FIG. 6 is an end view (in relation to FIG. 1) of the sharpener sheath of FIG. 1 in accordance with the present invention.

FIG. 6 is an end view in relation to FIG. 1 of the sharpener sheath device 10. FIG. 6 depicts opening 20 preferably formed in cap 24 in alignment with slot 56 in curved section 34. In one preferred embodiment, slot 56 and opening 20 are in fluid communication with each other, forming one opening in the first end 16 (best seen in FIG. 4). Slot 56, in addition to aligning the blade for insertion/withdrawal, acts to protect both the user and the surrounding work surface by preventing the knife from being withdrawn too quickly or in a haphazard manner.

The sharpening and biasing actions of the present invention can be better understood by reviewing FIG. 7. FIG. 7 is an left side elevational view in relation to FIG. 1 partially in section, taken substantially along line VII—VII of FIG. 4 depicting trigger 66 and trigger locking device 78 in an engaged position.

The sheath device 10 includes sharpening device 64 having a sharpener portion 92 contained in scabbard 12 for selective sharpening engagement with an edge of the knife blade.

In one preferred embodiment, engagement device 62 is in operable communication with the sharpening device 64 for selective sharpening engagement. In the embodiment of FIG. 7, sharpening device 64 is in contact with and secured to an inner surface 94, preferably by a screw device 96. While screw device 96 is preferred, other means are contemplated for securing sharpening device 64 to trigger 66, including pins, glue, bonding or the like.

Figure 8:
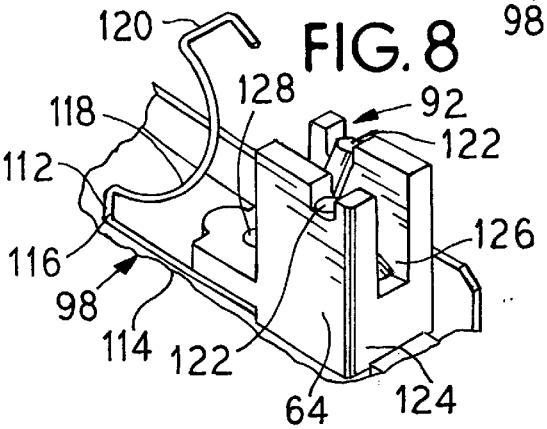
FIG. 8 is an enlarged fragmentary view of the sharping and biasing devices in accordance with the present invention.

A biasing device 98 is shown in FIG. 8 in operable communication with the scabbard 12 and engagement device 62. Preferably, the biasing device 98 is in communication with inner surface 38 of housing 22 and inner surface 94 of trigger 66, where biasing device 98 biases trigger 66 in a disengaged position, when trigger locking device 78 is disengaged. Sharpener device 64 further provides a friction fit with the knife blade, and along with locking device 58, prevents unintentional and accidental removal of the blade from the scabbard.

FIG. 7 depicts trigger 66 in an engaged position. In this engaged position, as selected by the user, the knife blade is sharpened by sharpening device 64 upon each insertion/withdrawal. Moreover, this engaged position is suitable for safely storing the sheath 10 (and the knife blade).

As provided above, when trigger device 66 is not locked in the engaged position shown in FIG. 7, the engaged position is selected by the user by manually moving trigger 66 towards the housing 22, compressing biasing device 98 as shown in FIG. 7. The user locks trigger 66 in the engaged position by moving trigger locking device 78 to the second, engaged position, which is in proximity to proximal end 90 of trigger 66.

In the second, engaged position, trigger locking device 78 engages a locking portion of the housing 22. Trigger locking device 78 includes an extended lip portion 100 that releasably engages a shoulder 102 formed by inner surface 38 of housing 22. Alternatively, shoulder 102 could be defined by an internal portion of cap 24. When extended lip portion 100 engages shoulder 102, trigger 66, and thus sharpening device 64, is locked in the engaged position.

Finally, FIG. 7 reveals a chamber 104 defined by inner surface 38 of housing 22 and inner surface 94 of trigger 66. In one preferred embodiment, chamber 104 is in fluid communication with passage 54 and opening 20, for receiving and storing the knife blade.

Figure 9:
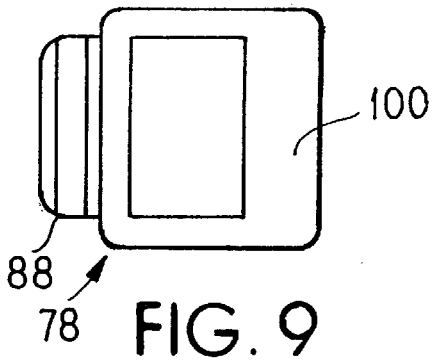
FIG. 9 is an enlarged top plan view of the trigger locking device of FIG. 5.
Figure 10:
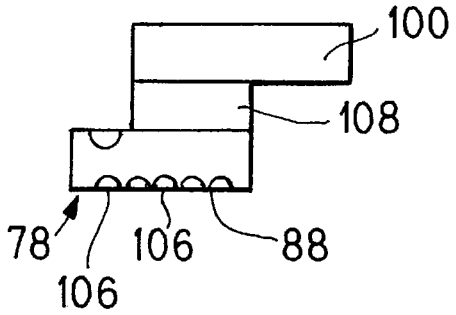
FIG. 10 is an enlarged side elevational view of the trigger locking device of FIG. 9.

Turning to FIGS. 9 and 10, an enlarged view of one embodiment of trigger locking device 78 is depicted. As described previously, trigger locking device 78 is preferably made of plastic and includes finger engagement portion 88, preferably having a plurality of indents 106. Extended lip portion 100 is joined to finger engagement portion 88 by connector portion 108. It is contemplated that locking device 78 be formed of separate pieces or as a single unit. In use, extended lip portion 100 engages shoulder 102 as described above, locking trigger 66 in the engaged position.

Figure 11:
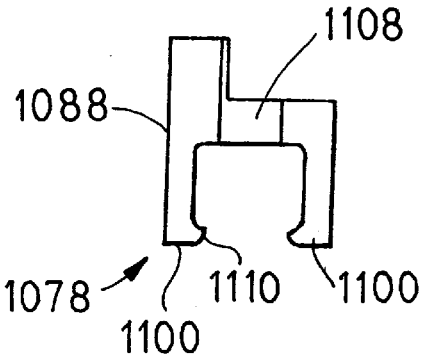
FIG. 11 is an enlarged side view of an alternate embodiment of the trigger locking device of FIG. 5.
Figure 12:
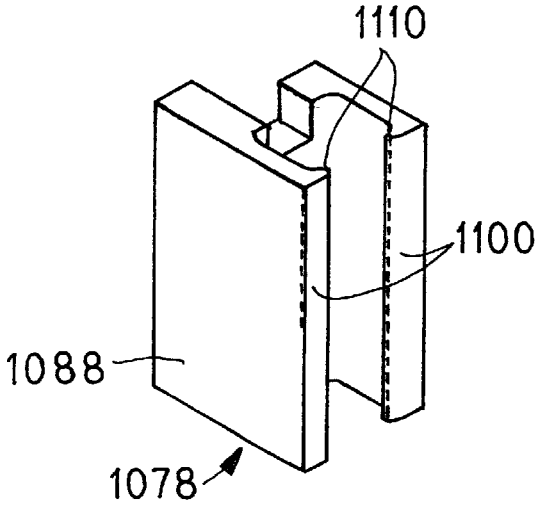
FIG. 12 is an enlarged perspective view of the trigger locking device of FIG. 11.

Alternatively, it is contemplated that the trigger locking device 1078 have two extended lip portions 1100 formed with lip edges 1110 as shown in FIGS. 11 and 12. FIG. 11 depicts an enlarged side view of an alternate embodiment of the trigger locking device 78 of FIGS. 5, 7, 9 and 10. Correspondingly, where appropriate, the last three digits of the 1000 series of numerals depicted in FIGS. 11–12 are connected to elements which have the same function and/or structure as those described in FIGS. 9–10.

The trigger locking device 1078 of FIGS. 11 and 12 includes finger engagement portion 1088, preferably, but not necessarily, having a plurality of indents 1106 (not depicted). Extended lip portions 1100 are joined to finger engagement portion 1088 by connector portion 1108. Extended lip portions 1100 and lip edges 1110 engage opposing sides of shoulder 1102 (not shown) as described above, locking trigger 66 in the engaged position.

While trigger locking devices 78, 1078 comprised of rigid plastic are preferred, other locking devices and materials are contemplated. It is contemplated that the locking device is circular, having an extended lip portion that engages shoulder 102 in a rotational manner. Additionally a locking device, among others, is contemplated having a finger engagement portion in contact with a tongue, where the tongue engages a slot formed in shoulder 102.

Turning back to FIG. 7, biasing device 98 is shown in communication with inner surfaces 38 and 98, where biasing device 98 biases trigger 66 in an disengaged position when trigger locking device 78 is moved to the disengaged position.

Figure 13:
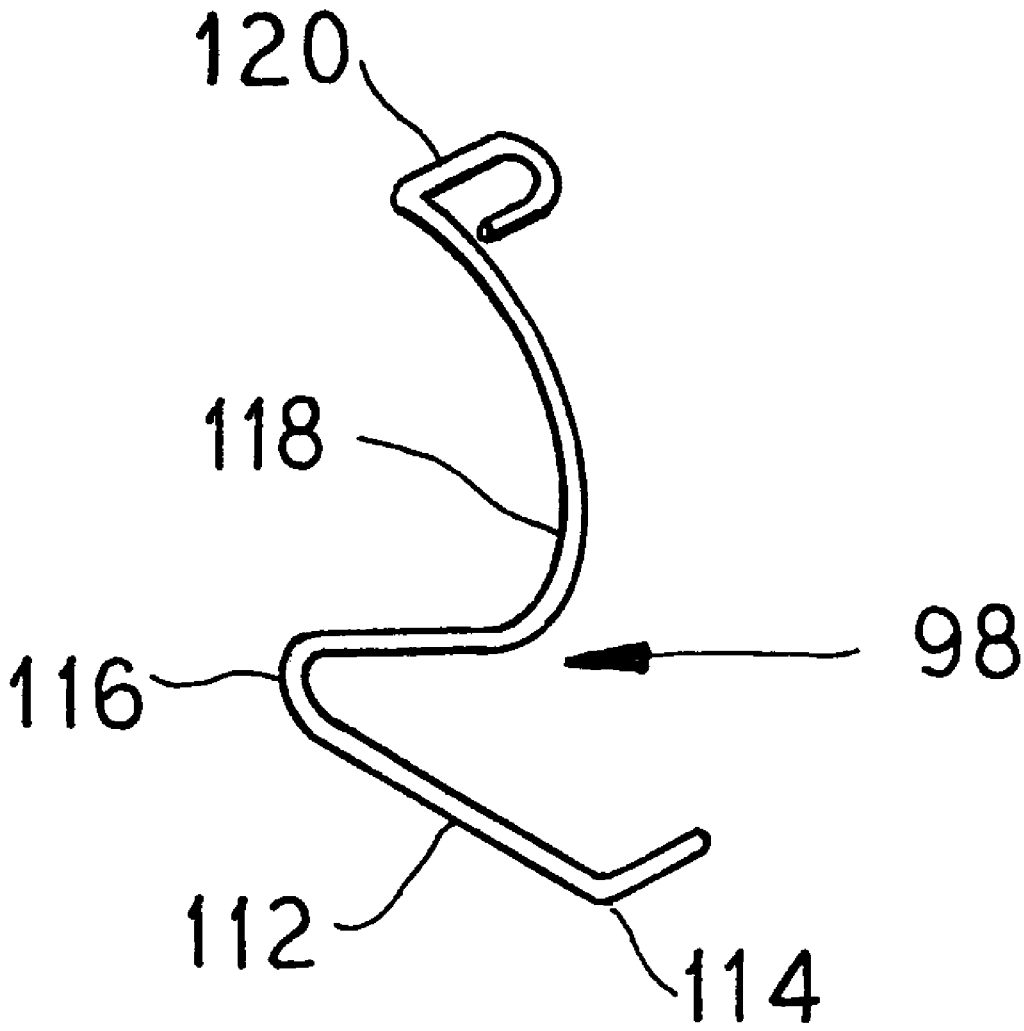
FIG. 13 is an enlarged perspective view of the biasing device of FIG. 8.

As shown in FIGS. 7, 8 and 13, biasing device 98 is preferably a spring member 112 in communication with scabbard 12 and engagement device 62. In one preferred embodiment, spring device 112 is a wire made of a shape retaining material, including stainless steel, steel alloys, aluminum, and the like. While a wire is preferred, other devices, including a helical spring or shape retaining spring bar, are contemplated.

Turning to FIG. 13, spring device 112 includes an L-shaped portion 114, a first curved portion 116, a bent curved portion 118 and a second curved portion 120 which could be square-like (FIG. 8) or D-shaped (FIG. 13). The L-shaped portion 114 engages inner surface 94 of trigger 66 and is held in place by sharpening device 64 and screw device 96 (best seen in FIGS. 7 and 8).

Correspondingly, second curved portion 120 operably engages inner surface 38 of the housing 22, held in place by the compressive force of bent curved portion 118. As described previously, when trigger locking device 78 is in the disengaged position, spring member 112 biases trigger 66 in the disengaged position. Alternatively, when trigger 66 is moved towards housing 22, spring member 112 is compressed.

Attention may now be paid to sharpening device 64. Sharpening device 64 includes sharpening portion 92 contained in scabbard 12. In one preferred embodiment, sharpening portion 92 includes at least one, but preferably two, sharpening edges 122.

As depicted, sharpening device 64 includes sharpener housing 124 defining a sharpener slot 126 and an aperture 128. Sharpener housing 124 has a box-like shape and is preferably made of rigid plastic suitable for injection molding, although other shapes and materials are contemplated.

Aperture 128 is utilized to secure sharpening device 64, and spring member 112, to inner surface 94 by means of screw device 96. Furthermore, sharpener slot 126 is aligned with opening 20 and slot 56, for receiving the knife blade in a rolling or sliding manner.

As discussed above, sharpener device 64 includes at least one, but preferably two, sharpener edges 122 for selective sharpening engagement with at least one side of a knife edge. In FIG. 8, the sharpener edges 122 are rod-like and preferably made of ceramic or other material suitable for sharpening the knife blade.

Sharpener edges 122 are fixed in sharpener housing 124 by screws, glue, bonding or the like, at a predetermined angle to engage two sides of the edge of the knife blade. This angle is determined so that a maximum portion of the sharpening edges 122 engages the edge of the knife blade when sharpening is desired and the engaged position selected.

As described above, trigger 66 is selectively operable in two positions. In one, disengaged, position best viewed in FIG. 3, trigger locking device 78 is moved to the disengaged or unlocked position. Trigger locking device 78 is moved away from proximal end 90 of trigger 66, so that trigger 66 is biased in an disengaged position by biasing device 98. This allows the user to selectively sharpen the blade upon insertion/withdrawal, by pivotally moving trigger 66, and thus the sharpening device 64, into an engaged position, preferably by manually squeezing trigger 66 towards the housing 22. As long as trigger 66 is not moved into the engaged position, the knife blade can be inserted/withdrawn without sharpening.

In the second, engaged position best viewed in FIG. 2, trigger locking device 78 is moved to the engaged or locked position as desired by the user. Trigger 66 is pivotally moved into the engaged position, preferably by hand, and trigger locking device 78 is moved towards proximal end 90 of trigger 66. This locks trigger 66 in the engaged position. This allows the user to sharpen the blade upon each insertion/withdrawal. Moreover, this engaged position allows the sheath device 10, and knife blade, to be safely stored, in a drawer for example.

As discussed above, sharpener device 64 is moved into selective sharpening engagement with at least one side of a knife edge through pivotal movement of the engagement device 62. Moving the trigger 66, so that sharpening device 64 engages the knife blade, moves the sharpener edges 122 into engagement with the two sides of the edge of the knife blade. As the knife blade is inserted/withdrawn sharpener edges 122 engage the edge of the knife blade, honing it as desired by the user.

Furthermore, the sheath 10 can be used to lock the knife blade in the scabbard 12, whereby unintentional and accidental removal of the blade is prevented. As first pointed end of knife blade is lined up with slot 56 and the knife blade is inserted into the scabbard 12 via opening 20. During insertion, the foremost portion of the knife blade handle slidably engages front engagement section 60 of curved section 34. As pressure is applied to the handle, the foremost portion of the handle slides over the front engagement section 60 and curved section 34 until it comes to rest between and frictionally engages second and third flat sections 30, 32.

The foremost portion of the handle is now located between the second flat section 30 and curved portion 34 so that the knife blade is effectively frictionally locked in the scabbard 12. The knife blade remains safely ensconced in the locking device 58, until upward and outward pressure is applied to the handle to overcome the friction fit and withdraw the knife blade from scabbard 12.

It will be readily apparent from the foregoing detailed description of the invention and from the illustrations thereof that numerous variations and modifications may be effected without departing from the true spirit and scope of the novel concepts or principles of this invention.

We claim:

1. A device for storing and selectively sharpening a knife, comprising:

a scabbard having opposing first and second ends with an opening defined in said first end, and a passage defined in said scabbard for receiving a knife blade;

a sharpening device within said scabbard; and an engagement device connected to said sharpening device and movably mounted to said scabbard and selectively movable between an engaged position in which the sharpening device engages a knife blade received within the passage and a disengaged position in which the sharpening device does not engage a knife blade received within the passage.

2. The device of claim 1 wherein said sharpening device includes a sharpener portion selectively engageable in sharpening engagement with an edge of said knife blade.

3. The device of claim 2 wherein said sharpener portion includes at least one sharpening edge selectively engageable in sharpening engagement with at least one side of said edge of the knife blade.

4. The device of claim 1 wherein a biasing device engages said scabbard and the engagement device and biases said engagement device toward the disengaged position.

5. The device of claim 4 wherein said biasing device comprises a spring member.

6. The device of claim 1 wherein said engagement device comprises a trigger device engaging said sharpening device and pivotably engaging said second end, whereby said sharpening device is selectively moveable.

7. The device of claim 6 wherein the second end of said scabbard includes a pivot device pivotally engaging the trigger device.

8. The device of claim 1 further including a trigger locking device selectively engageable with the engagement device and the scabbard to lock the engagement device in the engaged position.

9. The device of claim 1 wherein said passage is in communication with said opening defined in said first end.

10. The device of claim 1 wherein said scabbard includes a locking device engageable with the knife to lock the knife in the scabbard, whereby the knife is prevented from being unintentionally removed from said scabbard.

11. A device for storing and selectively sharpening a knife, comprising:

a scabbard having opposing first and second ends with an opening defined in said first end and a passage defined in said scabbard for receiving a knife blade, said passage in communication with said opening;

a sharpening device including a sharpening portion selectively engageable with said knife blade in sharpening engagement; and a trigger device movably mounted to said scabbard, connected to the sharpening device and selectively moveable with the sharpening device relative to said passage defined in said scabbard.

12. The device of claim 11 wherein said sharpener portion includes at least two sharpening edges selectively engageable with two sides of an edge of the knife blade in sharpening engagement.

13. The device of claim 11 further including a spring member engaging said scabbard and said trigger device, biasing said trigger device toward a disengaged position in which the sharpener portion does not engage the knife blade.

14. The device of claim 13 further including a pivot device pivotally connecting said trigger device and said scabbard.

15. The device of claim 14 further including a trigger lock device selectively engaging said trigger device and said scabbard to lock the engaging device in an engaged position in which said sharpener portion is engageable with said edges of said blade.

16. The device of claim 15 wherein said scabbard includes a locking device at said first end engageable with the knife to lock the knife in the scabbard, whereby the knife is prevented from being unintentionally removed from said scabbard.

17. The device of claim 16 wherein at least said scabbard, said trigger device and said locking device are formed of a molded plastic.

18. A device for storing and selectively sharpening a knife, comprising:

a scabbard defining a passage for receiving a knife blade;

a knife sharpener; and a trigger movably mounted to the scabbard and connected to the knife sharpener, the trigger selectively moveable between an engaged position in which the knife sharpener is engageable with a knife blade received within the passage and a disengaged position in which the knife sharpener does not engage a knife blade received within the passage.

19. The device of claim 18 further including a biasing member engaging the scabbard and the trigger, and biasing the trigger toward the disengaged position.

20. The device of claim 19 further including a trigger lock selectively engageable with the trigger and the scabbard to lock the trigger in the engaged position.

* * * * *